US008590213B2

(12) United States Patent
Scarfo

(10) Patent No.: US 8,590,213 B2
(45) Date of Patent: Nov. 26, 2013

(54) APPARATUS AND METHOD FOR WATERPROOFING A BASEMENT

(75) Inventor: Steven Scarfo, Dover, NJ (US)

(73) Assignee: Isela Chavez-Chiriboga, Dover, NJ (US)

( * ) Notice: Subject to any disclaimer, the term of this patent is extended or adjusted under 35 U.S.C. 154(b) by 35 days.

(21) Appl. No.: 12/915,776

(22) Filed: Oct. 29, 2010

(65) Prior Publication Data

US 2012/0102851 A1 May 3, 2012

(51) Int. Cl.
*E04D 13/14* (2006.01)

(52) U.S. Cl.
USPC ..... 52/51; 52/169.5; 52/302.6; 52/97; 52/716.2

(58) Field of Classification Search
USPC ..... 52/302.1, 169.5, 302.3, 302.6, 61, 62, 52/58, 97, 219, 741.1, 716.2
See application file for complete search history.

(56) References Cited

U.S. PATENT DOCUMENTS 2,703,002 A * 3/1955 Suskind ..... 52/302.3
3,287,866 A * 11/1966 Bevilacqua ..... 52/169.5
3,304,672 A * 2/1967 Bakke ..... 52/169.5
3,413,769 A * 12/1968 Hoyt ..... 52/198
3,427,810 A * 2/1969 Petersen ..... 405/43
3,850,193 A * 11/1974 Guzzo ..... 137/362
3,852,925 A 12/1974 Gazzo
4,134,268 A * 1/1979 Elmore ..... 405/43
4,136,500 A * 1/1979 DiFiore ..... 52/741.13
4,198,794 A * 4/1980 Younts, Jr. ..... 52/302.3
4,253,285 A * 3/1981 Enright ..... 52/169.5
4,265,064 A * 5/1981 Parezo ..... 52/302.3
4,271,648 A 6/1981 Johnson
4,333,281 A * 6/1982 Scarfone ..... 52/169.5
4,381,630 A * 5/1983 Koester ..... 52/169.5
4,486,986 A * 12/1984 Cosenza ..... 52/169.5
4,538,386 A 9/1985 DiCello
4,612,742 A * 9/1986 Bevilacqua ..... 52/169.5
4,745,716 A * 5/1988 Kuypers ..... 52/169.5
4,757,651 A * 7/1988 Crites ..... 52/169.5
4,869,032 A 9/1989 Geske
5,288,268 A * 2/1994 Kuypers ..... 454/341
5,367,842 A 11/1994 Janesky
5,501,044 A * 3/1996 Janesky ..... 52/169.5
5,630,299 A * 5/1997 Jackman et al. ..... 52/169.5
5,771,643 A * 6/1998 Parker ..... 52/169.5

(Continued)

*Primary Examiner* — Brian Glessner
*Assistant Examiner* — Babajide Demuren
(74) *Attorney, Agent, or Firm* — Servilla Whitney LLC

(57) ABSTRACT

A method and apparatus for waterproofing a basement are disclosed. Cinder or concrete block foundations and poured, solid concrete foundations can be waterproofed. Holes are formed in the foundation wall. A first system has a first plurality of holes through the foundation wall and a second plurality of holes can be partially through the foundation wall. A first side of a drain board is located adjacent the cinder or concrete block foundation wall and a second side located adjacent the top section of the footer so as to cover the first plurality of holes and to cover the second plurality of holes. A bed of stone is adjacent the side section of the footer and below the top section of the footer. A conduit rests in the bed of stone on a slope. The conduit has a plurality of perforations around a top section of the conduit and no perforations in a bottom section of the conduit. Water can flow through the first plurality of holes and the second plurality of holes and be guided by the drain board, the top section of the footer and the side section of the footer into the conduit.

21 Claims, 8 Drawing Sheets

(56) References Cited

U.S. PATENT DOCUMENTS

| | | | | |
|---|---|---|---|---|
| 5,845,456 | A | 12/1998 | Read | |
| 5,890,334 | A | 4/1999 | Hughes, Jr. | |
| 6,230,468 | B1 * | 5/2001 | Klaus | 52/741.11 |
| 6,550,190 | B2 * | 4/2003 | Ruiz et al. | 52/169.5 |
| 6,561,732 | B1 * | 5/2003 | Bloomfield et al. | 405/43 |
| 6,598,360 | B1 * | 7/2003 | Pratt | 52/169.5 |
| 6,672,016 | B2 * | 1/2004 | Janesky | 52/169.5 |
| 7,832,150 | B1 * | 11/2010 | Pratt | 52/61 |
| 7,836,640 | B1 * | 11/2010 | Pratt | 52/61 |
| 2007/0294965 | A1 * | 12/2007 | Andras | 52/169.5 |
| 2008/0028695 | A1 * | 2/2008 | Fennell | 52/169.5 |
| 2008/0190045 | A1 * | 8/2008 | Janesky | 52/169.5 |

* cited by examiner

APPARATUS AND METHOD FOR WATERPROOFING A BASEMENT

BACKGROUND

Water in basements is a typical problem faced by many homeowners. The problem can be created in a number of ways. For example, poorly constructed foundation walls can cause a problem. If a house is build in an area with a high water table, then when the water table rises the foundation walls can allow the water to come into a basement due to the pressure created by the water. Unforeseen flooding conditions can occur that allow water to enter a basement. Other conditions can create basement water problems as well.

Of course, the pressure exerted by the water can cause great damage. For example, once the water gets inside a basement it can cause great damage inside the basement. The water can damage the contents of the basement. The water can also cause the formation of mold which can be very harmful to health and very costly to remediate. The water can also cause damage to a foundation of a house or building.

Different systems and methods have been used to try to correct the problem. For example, sump pumps have been used to try to pump water that has entered a basement or a hole in the basement floor out of the basement. However, each of the systems and methods fail to satisfactorily fix the problem.

Accordingly, new and improved methods and apparatus for waterproofing basements are needed.

SUMMARY

Methods and systems for waterproofing basements are provided.

In accordance with one aspect of the present invention, a system of waterproofing a basement having foundation wall resting on a footer, and a floor, the footer having a top section and a side section is provided. The system includes a first plurality of holes through the foundation wall and a second plurality of holes partially through the foundation wall. A drain board having a first side is located adjacent the foundation wall and a second side of the drain board is located adjacent the top section of the footer so as to cover the first plurality of holes and to cover the second plurality of holes. A bed of stone lies adjacent the side section of the footer and below the top section of the footer. A conduit rests in the bed of stone on a slope, the conduit having a plurality of perforations around a top section of the conduit and no perforations in a bottom section of the conduit. Water can flow through the first plurality of holes and the second plurality of holes and be guided by the drain board, the top section of the footer and the side section of the footer into the conduit. The foundation wall can be a cinder or concrete block wall, a poured (solid) concrete wall or any other foundation wall that supports a house such as a brick wall.

A sump pump is provided at a first lower end of the conduit. The water flows through the conduit into the sump pump and is then pumped out so that no water enters the basement. The second, higher end of the conduit can be capped.

The first plurality of holes and the second plurality of holes are below the floor. PVC pipe or other pipe can be provided in the first plurality of holes. A filter can be provided in the pipe in the first plurality of holes. The filter can be a mesh filter. Mesh filters or other filters can also be provided in the pipe in the second plurality of holes. In one embodiment, each of the first plurality of holes has a diameter greater than each of the second plurality of holes and the first plurality of holes is spaced apart along the wall at least three feet between each of the first plurality of holes.

In accordance with one aspect of the present invention, the conduit does not have perforations in a bottom section of the conduit, but does have perforations in a top section. This allows water to enter the conduit and then flow through the conduit. In accordance with a further aspect of the present invention, the conduit does not have any perforation along an arc extending at least 30 degrees in each direction from the bottom of the conduit.

In accordance with another aspect of the present invention, the drain board is waffled to create channels so that water flows through the channels.

In one embodiment, the first plurality of holes is spaced apart along the foundation wall in the range of about four feet and seven feet and the second plurality of holes are formed in each cavity of each block. In one embodiment, the first plurality of holes is larger in diameter than the second plurality of holes. In one embodiment, the conduit is elongate and defined by a wall portion having perforations in a top section and a bottom section through the wall, the perforations laterally spaced along the conduit. In one embodiment, the foundation wall comprises a poured, solid concrete wall and the second plurality of holes in the foundation wall are below the floor level and end at an intersection of the footer and the foundation wall. In embodiments that include a poured concrete foundation of wall, the second plurality of holes can be formed at an angle with respect to the floor.

Methods of waterproofing a basement are also contemplated by the present invention. In accordance with one method, a portion of the basement floor is removed. A first plurality of holes is drilled through the foundation wall. A second plurality of holes is drilled into but not through the foundation wall. A waffled drain board is placed over a side of the foundation wall and over the top section of the footer to cover the first plurality of holes and the second plurality of holes. A drain pipe with a plurality of holes in a top section of the drain pipe are placed in a rock bed near the side section of the footer and below a bottom of the foundation wall such that the drain pipe is sloped toward a sump pump. The drain pipe does not have holes in a bottom section of the drain pipe. The floor is then replaced.

The method can further include inserting a filter into a plurality of pipes and placing the plurality of pipes into each of the first plurality of holes. Further, a second plurality of pipes can be inserted into each of the first plurality of holes. The filters can be a mesh filter and the pipes can be PVC pipes.

As before, the first plurality of holes and the second plurality of holes are below a level of the floor.

In accordance with a further aspect of the present invention, the foundation wall includes a plurality of cinder or concrete blocks and each of the cinder or concrete blocks has a plurality of cells and herein each of the plurality of cells includes either one of the first plurality of holes or one of the second plurality of holes.

In accordance with another aspect of the present invention, a system of waterproofing a basement having a poured (solid, and not hollow) concrete foundation wall and a floor is provided. The foundation wall rests on a footer. The footer has a top section and a side section. The system includes a plurality of weep holes through the foundation wall that are below the floor level and that end at an intersection of the footer and the foundation wall. There is a drain board having a first side located adjacent the cinder or concrete block foundation wall and a second side located adjacent the top section of the footer, so as to cover the plurality of drain holes. A bed of stone rests adjacent the side section of the footer and below the top section of the footer. A conduit rests in the bed of stone on a slope. The conduit has a plurality of perforations around a top section of the conduit and no perforations in a bottom section of the conduit. Water can flow through the plurality of holes and be guided by the drain board, the top section of the footer and the side section of the footer into the conduit. There is also a sump pump at the lower end of the conduit and the second, higher end of the conduit is capped.

As before, the drain board is waffled to create channels through which water can flow.

Corresponding methods of waterproofing a poured concrete basement are also provided.

Another aspect of the invention pertains to an elongate drain pipe for use with a basement drainage system comprising: a wall portion defining a generally tubular conduit having a top section and a bottom section and a length; a first plurality of perforations through a top section of the wall along the length of the conduit; a second plurality of perforations through a top section of the wall along the length of the conduit, the second plurality of perforations angularly spaced from the first plurality of perforations; a third plurality of perforations through a bottom section of the wall along the length of the conduit; and a fourth plurality of perforations through a bottom section of the wall along the length of the conduit, the fourth plurality of perforations angularly spaced from the third plurality of perforations, the third and fourth plurality of perforation being spaced such that water can flow along the bottom section of the pipe.

DESCRIPTION

Figure 1:
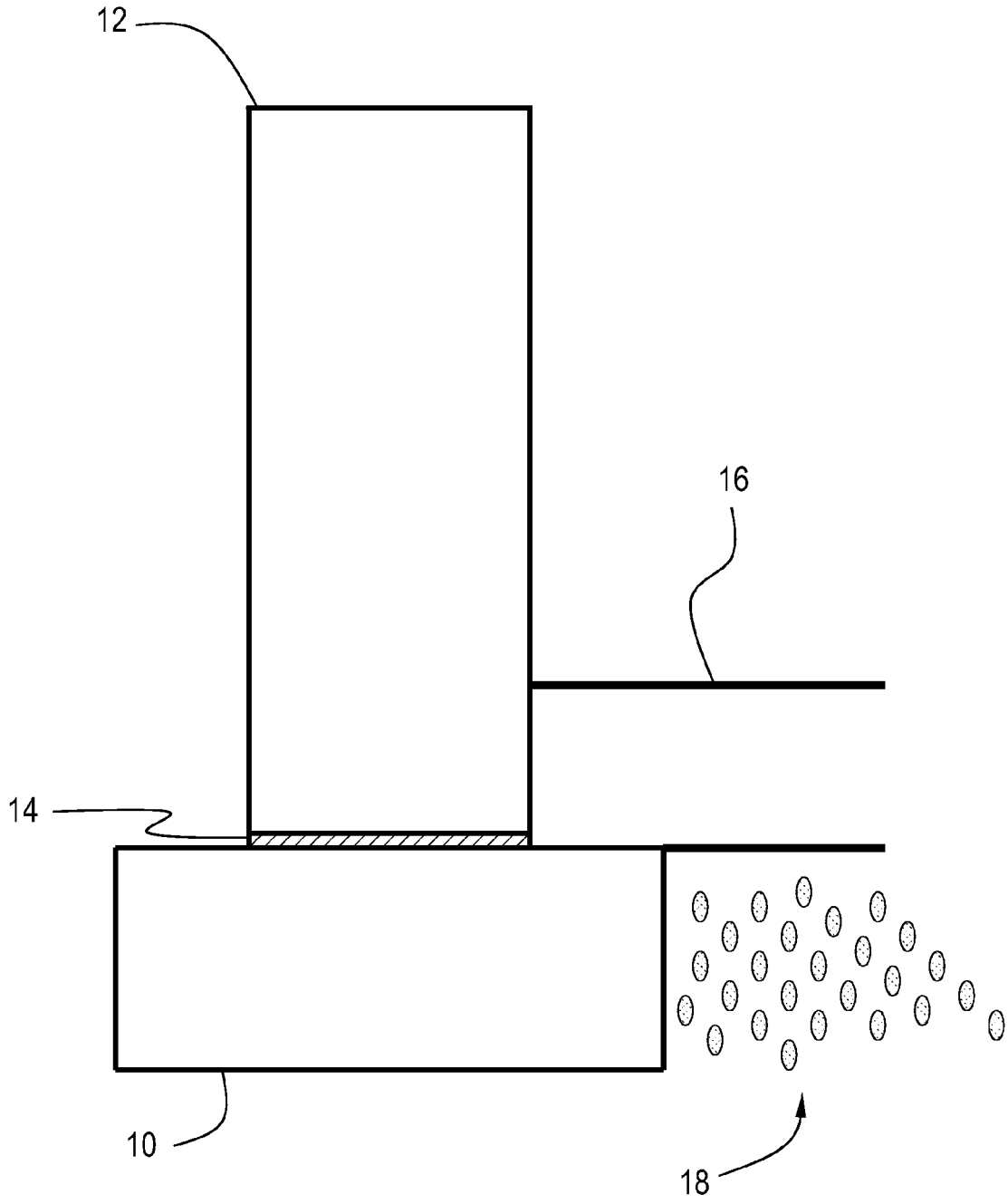
FIG. 1 illustrates a side plan view of a basement foundation wall sitting on a footer.

FIG. 1 illustrates a side plan view of a known basement 1 structure. The basement 1 is formed by a ceiling 2, a foundation wall 12 and a floor 16. The foundation wall 12 is built on a footer 10. The foundation wall 12 can be constructed with cinder or concrete blocks or can be a poured concrete foundation, wherein the foundation wall is formed by pouring or otherwise depositing a solid mass of concrete in a form to define a solid, not hollow wall. FIG. 1 illustrates a cinder or concrete block foundation that has a mortar bed 14 between the footer 10 and a first layer of cinder or concrete blocks in the cinder or concrete block foundation wall 12. The floor 16 is typically a concrete floor that is poured over a gravel, rock or stone bed 18. As used herein, the terms gravel, rock and stone are used synonomously.

Basements constructed in accordance with FIG. 1 are prone to problems, as previously discussed. Water frequently finds its way into the basement 1 through any number of ways. Water can go through holes in the foundation wall 12. Pressure can force the water through the wall 12 or through the mortar bed. As mentioned above, the water can cause severe problems in the basement 1.

Figure 2:
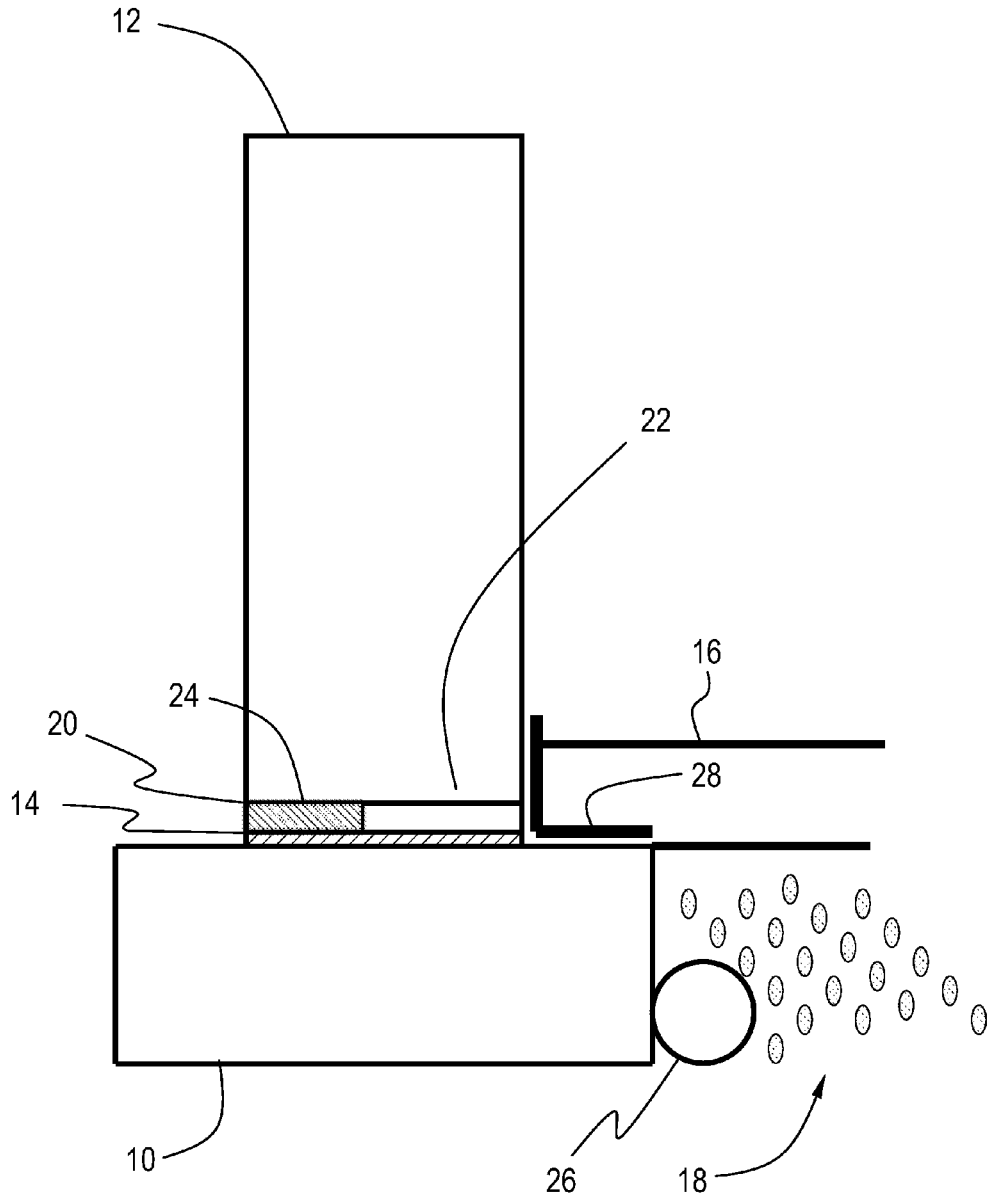
FIG. 2 illustrates a side plan view of a basement and footer in accordance with an aspect of the present invention.

FIG. 2 illustrates a side plan view of a basement in accordance with an aspect of the present invention. To construct the system of FIG. 2, a portion of the floor 16 is removed. Only a portion of the floor 16 needs to be removed, and care is taken not to damage the footer 10. If the floor 16 is a concrete floor it can be removed by sledge hammer, jack hammer or the like.

Once the floor 16 is removed, the stones 18 are exposed. A portion of the stone is removed and a conduit 26 is placed in the stone bed 18. The conduit 26 is then covered with the stones 18. The conduit 26 is laid into the stone bed 18 with a slope so that one end of the conduit 26 drains into a hole in the basement floor 16 that has a sump pump in it. The other end of the conduit can be capped.

The conduit 26 can be PVC pipe having a four inch inner diameter with perforations in a top section of the pipe and no perforations in a bottom section of the conduit 26. This allows water to freely enter the conduit 26 and then flow down the conduit 26 to a sump pump.

A plurality of holes 20 are also drilled into the foundation wall 12. In accordance with an aspect of the present invention, some of the plurality of holes 20 are drilled all the way through the wall 12 and other of the plurality of holes 20 are drilled partially through the wall 12. The holes 20 can be drilled that a one inch diameter PVC pipe 22 can be inserted into some of the holes 22, particularly the holes extending all the way through the wall.

In accordance with an aspect of the present invention, the PVC pipe 22 is inserted into the holes 20 which are drilled all the way through the wall 12. A mesh filter 24 or any other type of filter can be inserted into the pipes 22 that are inserted into the holes 20. The filter 24 can also be placed only in the pipes 22 that extend all the way through the wall 12 or the filter 24 can be placed in all of the pipes 22. The filter 24 is particularly effective in preventing dirt and other material from outside the foundation wall 12 from clogging the system.

A drain board 28 is placed near the side of the foundation wall 12 and over a top section of the footer 10. The drain board 28 covers the plurality of holes 22, which are usually below a surface of the floor of the basement.

Thus, water that would ordinarily come into the basement is directed through the holes 20, down between the drain board 28 and the side of the wall 12, then between the drain board 28 and the top of the footer 10 and finally into the conduit 26 in the bed of stones. The water flows along the sloped conduit 26 into a sump pump and is removed.

Figure 3:
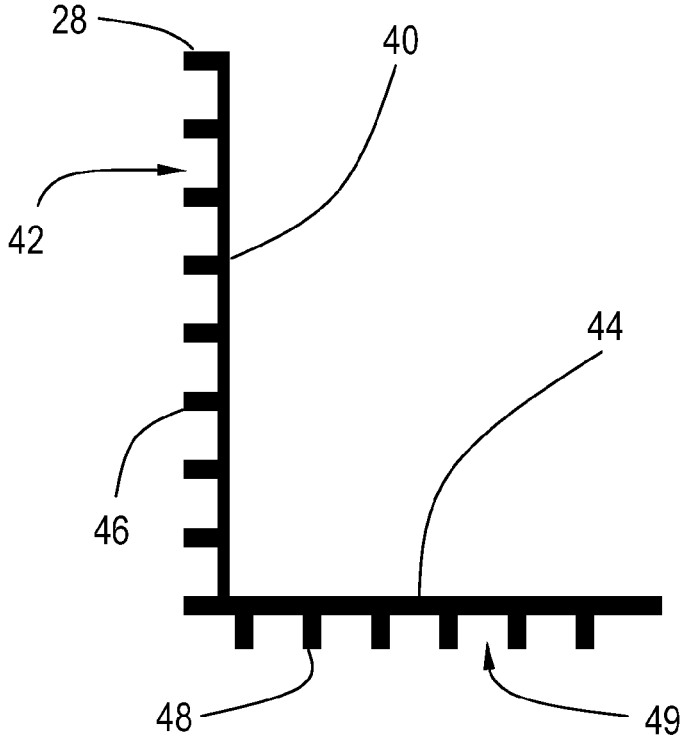
FIGS. 3 and 4 illustrate a polymeric drain board that can be used in the system illustrated in FIG. 2 in accordance with an aspect of the present invention.

FIG. 3 illustrates a drain board 28 that can be used in the system illustrated in FIG. 2 in accordance with an aspect of the present invention. As described below, the drain board 28 is has a waffled pattern comprising a plurality of indentations on a side and on a bottom. As illustrated in FIG. 2, the drain board 28 is placed at the base of the foundation wall 12 and against the footer 10 when the floor 16 is removed. The drain board 28 can be made of a polymeric material. The drain board 28 has a first wall 40 which is vertically oriented in FIG. 2. It also has a wall 44 that is horizontally oriented in FIG. 2. The vertically oriented wall 40 has a series of projections 46 that protrude from one side of the wall 40 and that run from the top of the wall 40 to the bottom of the wall 40. They also run from side to side on the wall 40. These projections 46 create channels 42 in the wall 40. When the drain board 28 is placed in the position illustrated in FIG. 2, the projections 46 meet the foundation wall 12 so that water can drain off the wall 12 through the channels 42.

The horizontally oriented wall 42 also has similar projections 48 that extend from one side of the wall 44. These projections 48 extend over the entire face of the wall 44, as illustrated. The projections 48 form channels 49. When the drain board 28 is placed in the position illustrated in FIG. 2, the projections 48 meet the top of the footer 10 so that water can drain through the channels 49. Eventually, the water reaches the conduit 26 and is drained away.

Figure 4:
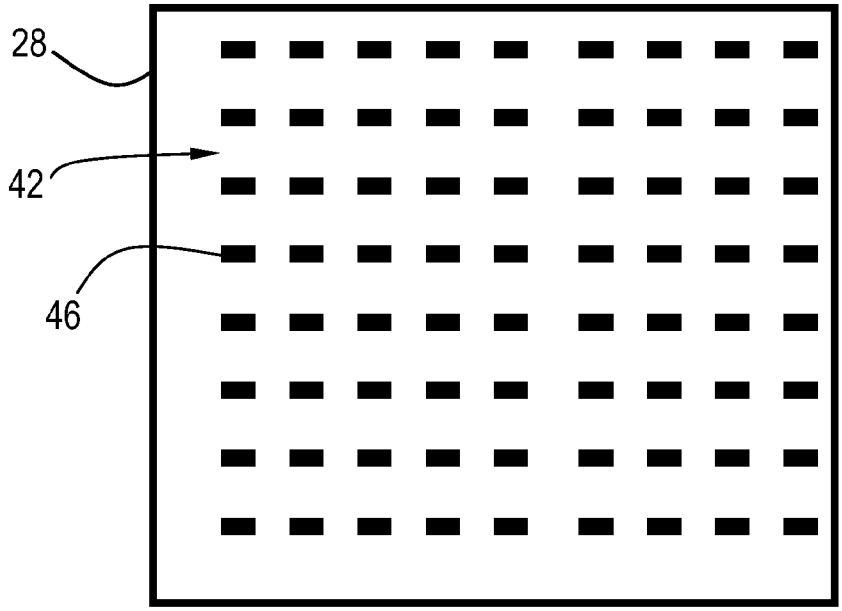

The waffled side and bottom of the drain board 28 is clearly illustrated in FIG. 4. As can be seen, the projections 46 extend over the entire surface of the drain board 28, creating the channels 42.

Figure 5:
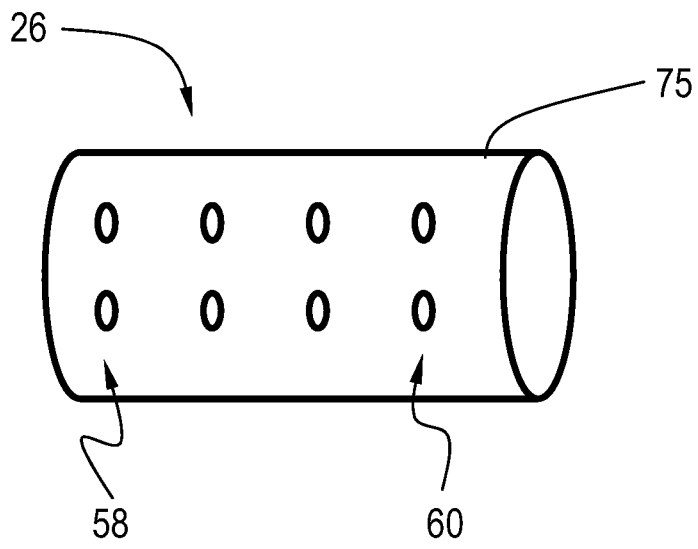
FIGS. 5 and 6 illustrate a drain pipe that can be used in the system illustrated in FIG. 2 in accordance with an aspect of the present invention.
Figure 6:
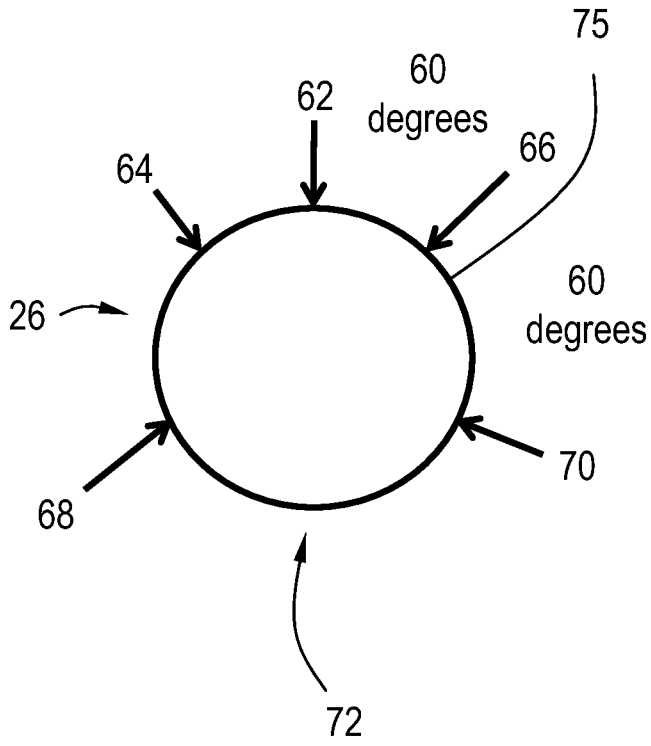

FIGS. 5 and 6 illustrate an elongate drain pipe 26 that can be used in the system illustrated in FIG. 2 in accordance with an aspect of the present invention. In one embodiment, the drain pipe 26 can be an elongate PVC pipe having a wall 75 defining a generally tubular conduit with an outer diameter of about four inches with perforations 58 to 60 through the wall 75 in a top section but no perforations in the bottom section of the pipe 26. This allows water that is guided by the drain board 28 to flow into the drain pipe 26 or conduit and then to flow along the drain pipe 26. It will be appreciated that the outer diameter of the drain pipe can be varied, and can be at least about three inches, four inches, five inches or six inches in diameter in accordance with one or more embodiments.

In accordance with one aspect of the present invention, the drain pipe 26 has first and second groups of pluralities of perforations 58 to 60 through the wall 75. As shown in FIG. 6, the perforations are provided in a line at the top 62 of the drain pipe 26. If the top 62 of the drain pipe 26 is considered zero degrees, then a first and second plurality of perforations arranged linearly and extending along the length of the drain pipe 26 can be provided at lines 66 and 64, each of the lines 64 and 66 being radially offset from the top 62 line of perforations by about sixty degrees. Another two lines (or second and third pluralities) of perforations can be provided and extend linearly at lines 68 and 70, each of which extend along the length of the drain pipe 26 are radially offset from the top 62 line of perforations by about one hundred twenty degrees. The perforations 58 and 60 can be provided along the length of the drain pipe 26 on the illustrated lines in the drain pipe every two to four inches, for example at a distance of about three inches.

The perforations 58, 60 can be in the range of about one-quarter inch (¼") to about one-half inch (½" in diameter. The drain pipe or conduit 26 can be constructed by obtaining existing pipe that already has perforations 58, 60 in it and drilling additional perforations as needed.

In accordance with one aspect of the present invention, the perforations need not be in straight lines, but can be provided in any pattern in the top portion of the conduit 26. In accordance with a further aspect of the present invention, the perforations are not located in the bottom section 72 of the conduit. The bottom section 72 of the conduit can include an arc section of the conduit/drain pipe 26 that does not include perforations. This arc section extending between lines of perforations 68 and 70 that does not include perforations shown in FIG. 6 is at least about 60 degrees, or extends 30 degrees in each direction. In specific embodiments, the bottom section that does not include perforations includes an arc of at least about 100 degrees or at least about 120 degrees. Structure according to one or more embodiments in which a bottom arc section does not include perforations provides proper flow of water through the conduit/drain pipe 26 in the system so that water does not drain through the bottom section of the pipe 26.

Figure 7:
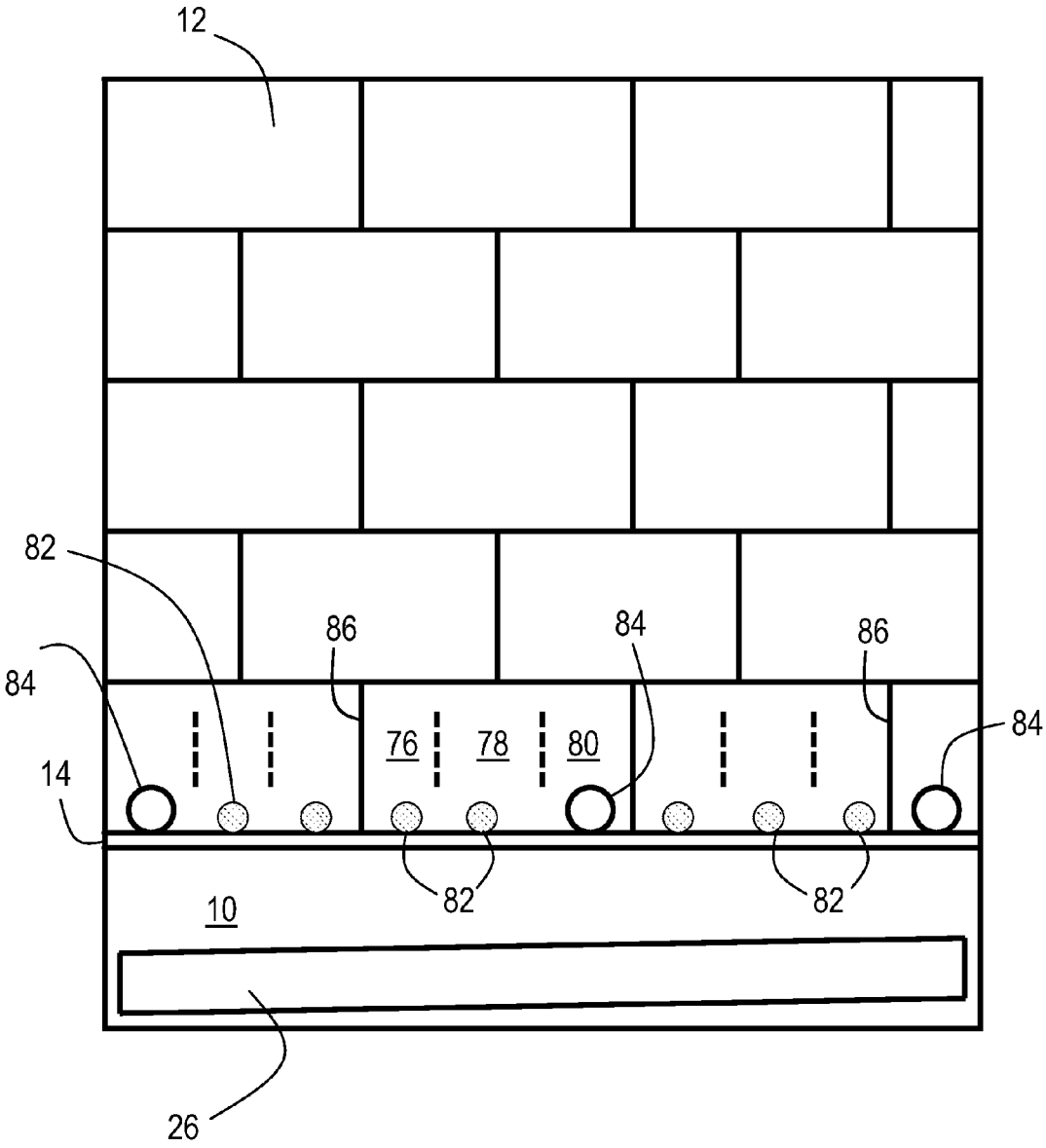
FIG. 7 illustrates a view of the system illustrated in FIG. 2 from inside a basement.

FIG. 7 illustrates a view of the system illustrated in FIG. 2 from inside a basement. The wall 12 in FIG. 7 is a cinder or concrete block wall that rests on the footer 10, comprising a plurality of courses of cinder or concrete block stacked upon each other to form a foundation wall. The slope of the drain pipe/conduit 26 is illustrated. A first plurality of holes 84 or "through holes" is provided fully through the wall 12. These through holes 84 are shown open in FIG. 7. There is a second plurality of holes in the wall 82 just above the mortar bed 14 that is between the wall 12 and the footer 10. The second plurality of the holes 82, which may also be referred to as "weep holes," can be drilled only partially through the wall 12.

As shown in FIG. 7, each of the cinder or concrete blocks has a plurality of cells or cavities 76, 78 and 80. In accordance with one aspect of the present invention, the second plurality of holes or weep holes 82 is drilled into each of the cells of a cinder or concrete block. In accordance with another aspect of the invention, the second plurality of holes may be formed in each of the cells of the cinder or concrete block and in the vertical mortar joints 86. In accordance with a another aspect of the invention, the first plurality of holes or through holes 84 are spaced apart by at least about two feet, more specifically, at least about three feet, and even more specifically in the range of about four to seven feet. In a specific embodiment, there are at least three through holes 84 along the length of a wall. For example, as shown in FIG. 7, there are three through holes 84, through holes 84 adjacent the ends of the wall and a through hole between the through holes adjacent the ends of the wall. In one embodiment, each of the first plurality of holes has a diameter greater than each of the second plurality of holes and the first plurality of holes is spaced apart along the wall at least three feet between each of the first plurality of holes. For example, each of the first plurality of holes typically has a diameter of one inch or larger, while each of the second plurality of holes is smaller than three quarters of one inch (¾"), or more specifically less than about five eighths of one inch (⅝"), for example, one half of one inch (½").

Figure 8:
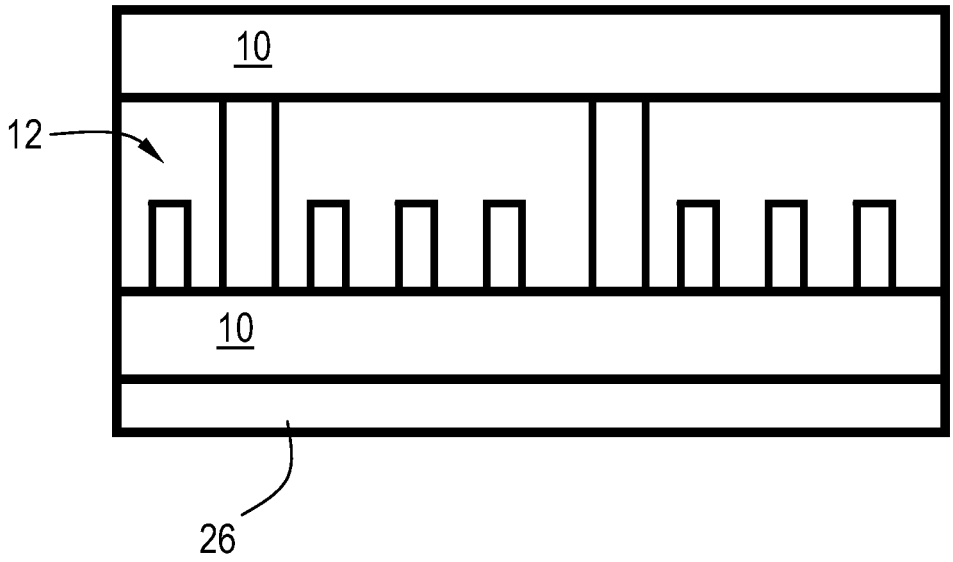
FIG. 8 illustrates a top view of the system illustrated in FIG. 2.

FIG. 8 illustrates a top view of the system illustrated in FIG. 2. The wall 12 is resting on the footer 10. The drain pipe 26 rests adjacent the footer 10. As can be seen most of the holes in the wall 12 are only drilled partially through the wall 12. Some of the holes are drilled all the way through the wall 12.

Figure 9:
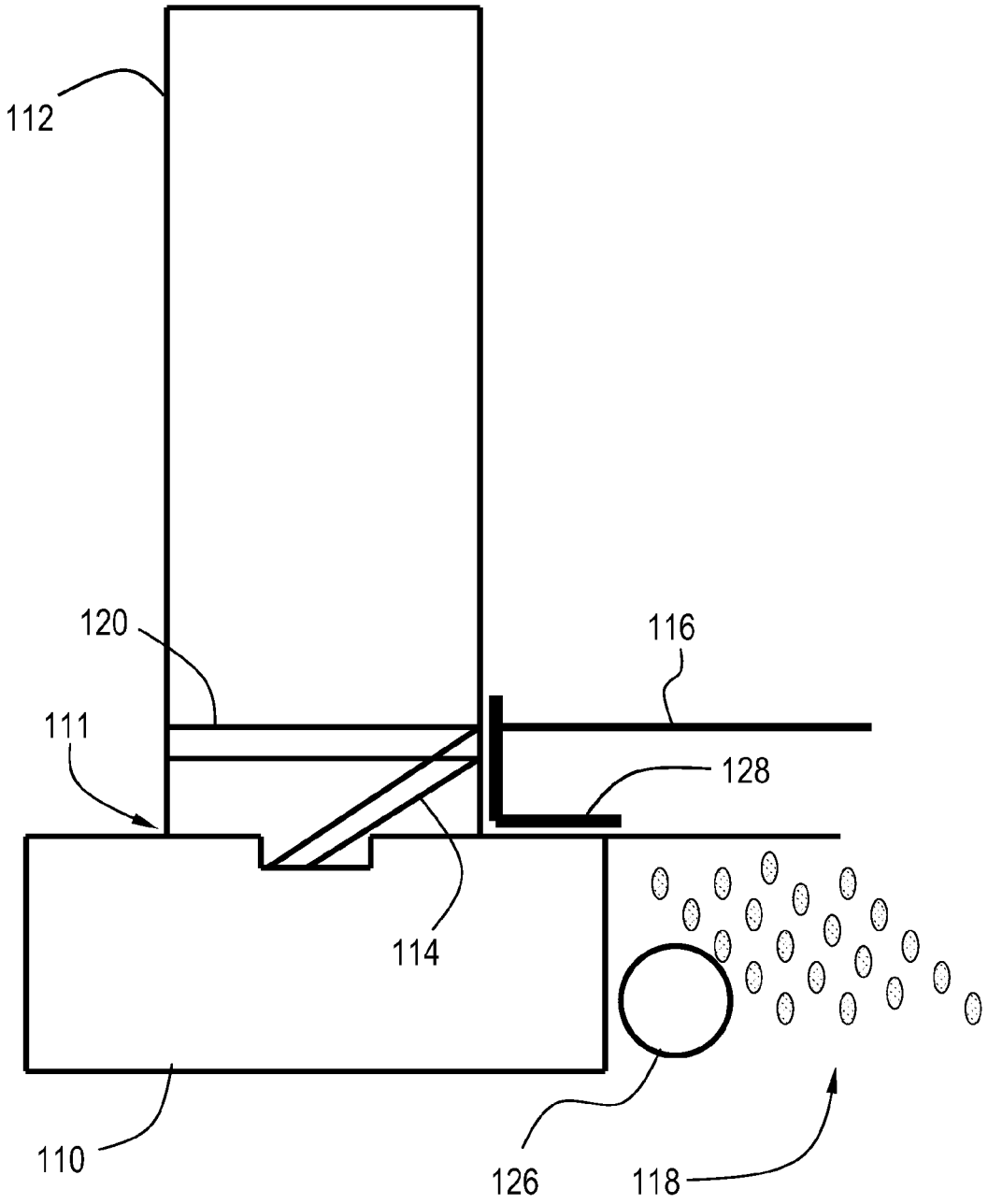
FIG. 9 illustrates a system in accordance with an aspect of the present invention that can be used in connection with waterproofing a basement that was formed from poured concrete walls.

FIG. 9 illustrates a system in accordance with an aspect of the present invention that can be used in connection with waterproofing a basement that was formed from poured concrete walls. In accordance with another aspect of the present invention, a plurality of weep holes 114 is drilled into the wall 112. The weep holes 114 are drilled into the intersection 111 between the footer 110 and the wall 112 and formed at an angle with respect to the floor. A drain board 128 is placed as described before. A drain pipe 126 is placed in a bed of stone 118.

The system shown in FIG. 9 is constructed similarly as described before. A floor 116 is partially removed. The weep holes 114 are drilled or otherwise formed through the wall 112. In addition, similar to the system described above with respect to FIG. 2, through holes 120 can be placed through the wall as shown in FIG. 9. It will be appreciated that the through holes 120 are placed substantially parallel to the floor 116, and a pipe and a filter can be placed into each of the through holes 120 as described above. Similar to the system described above with respect to FIG. 2, the through holes 120 can be spaced apart by at least about two, three or four feet, and in specific embodiments, the through holes are spaced apart in the range of four to about seven feet. A drain board 128 is placed over the weep holes 114 and through holes 120 and on top of a top section of the footer 110. The drain board 128 is waffled as described previously.

Water typically enters the area 111 and then travels up the weep hole 114. The water is guided by the drain board 128 to the drain pipe 126, the water flows in the drain pipe 126 to a sump pump. The weep holes 114 can be laterally spaced along a wall by any suitable distance, for example in the range of two to three feet, or in the range of four to five feet.

It will be appreciated that the systems described with respect to FIG. 2 for a block wall and FIG. 9 for a poured concrete wall can also be utilized in basement walls made from other materials such as brick walls. In basements with brick walls, the through holes can be centered at mortar joints.

Figure 10:
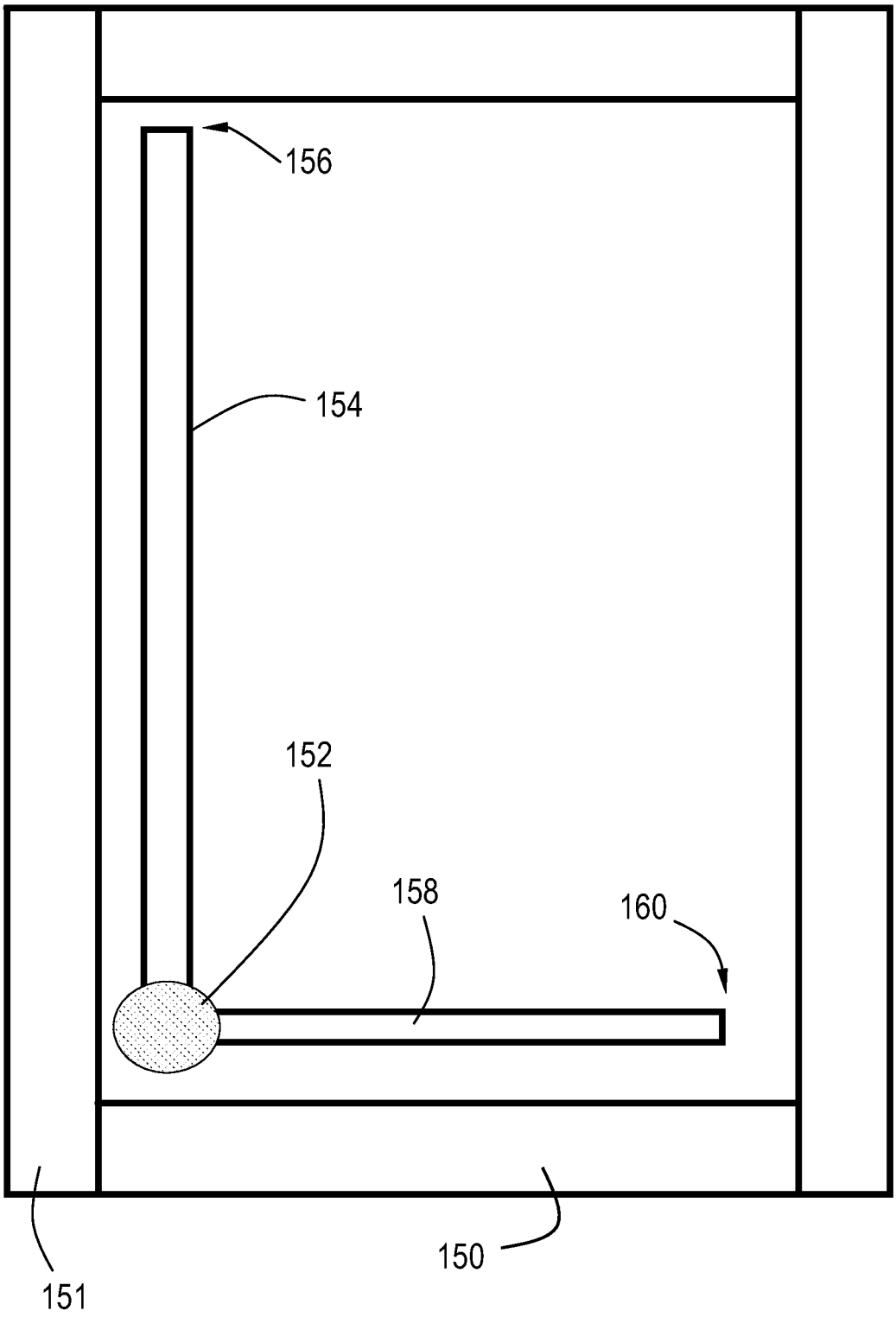
FIG. 10 illustrates a basement with a conduit and a sump pump installed in accordance with an aspect of the present invention.

FIG. 10 illustrates a basement having four foundation walls, including walls 150 and 151. In this case, the water problem is along walls 150 and 151. Holes are provided in the walls 150 and 151, as previously described. Conduit 154 is provided near the wall 151 in a bed of stone sloped toward a sump pump 152. The end 156 of the conduit 154 can be capped to prevent water from exiting that end of the conduit 154. Conduit 158 is provided near the wall 150 in a bed of stones, also sloped toward the sump pump 152. The end 160 of the conduit 158 can be capped to prevent water from exiting that end of the conduit.

The sump pump 152 can be located at any location along the connected conduit 154, 158. For example, if the sump pump 152 were located at the end 156 of the conduit 154, then conduits 154 and 158 could be joined together with a ninety degree joint and the end 160 of the conduit 158 could be capped. The joint could be glued with a standard PVC glue to secure the conduits together and to prevent water leakage.

If other walls have water problems, holes in those walls would be drilled or otherwise formed and conduit laid as illustrated in FIG. 10 with respect to walls 150 and 151.

In accordance with the method of constructing the illustrated systems, a portion of the floor of the basement is removed. The holes are drilled or otherwise formed. Optional pipes and mesh filters are installed in the holes. A drain board is installed. The drain pipe is installed in the bed of stoned in a sloped fashion. The floor is then re-installed.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

The invention claimed is:

1. A system of waterproofing a basement having a foundation wall resting on a footer, and a floor, the footer having a top section and a side section, the system comprising:

a first plurality of holes through the foundation wall;

a second plurality of holes partially through the foundation wall;

a drain board having a first side without holes located adjacent the foundation wall and a second side located adjacent the top section of the footer so as to cover the first plurality of holes and to cover the second plurality of holes, the drain board having an open section at the footer and the drain board covering the first and second plurality of holes;

a bed of stone adjacent the side section of the footer and below the top section of the footer;

a conduit resting in the bed of stone on a slope, the conduit having a plurality of perforations around a top section of the conduit and no holes in a bottom section of the conduit;

wherein water can flow through the first plurality of holes and the second plurality of holes and be guided by the drain board, through its open section over the top section of the footer and the side section of the footer into the conduit, wherein the foundation wall comprises cinder block or concrete blocks, each block having a plurality of cavities.

2. The system of claim 1, further comprising a sump pump at a first lower end of the conduit.

3. The system of claim 2, further comprising a cap at a second higher end of the conduit.

4. The system of claim 1 wherein the first plurality of holes and the second plurality of holes are below the floor.

5. The system of claim 1, further comprising pipe in the first plurality of holes.

6. The system of claim 5, wherein each of the first plurality of holes has a diameter greater than each of the second plurality of holes and the first plurality of holes is spaced apart along the wall at least three feet between each of the first plurality of holes.

7. The system of claim 5, wherein the pipe in the first plurality of holes is PVC pipe.

8. The system of claim 7, further comprising a filter in the pipe in the first plurality of holes.

9. The system of claim 8, wherein the filter is a mesh filter.

10. The system of claim 1, wherein the drain board is waffled to create channels so that water flows through the channels.

11. The system of claim 1, wherein the first plurality of holes is spaced apart along the foundation wall in the range of about four feet and seven feet and the second plurality of holes are formed in each cavity of each block.

12. The system of claim 11, wherein the first plurality of holes is larger in diameter than the second plurality of holes.

13. The system of claim 1, wherein the conduit is elongate defined by a wall portion having perforations in a top section and a bottom section through the wall, the perforations laterally spaced along the conduit.

14. A system of waterproofing a basement having a foundation wall resting on a footer, and a floor, the footer having a top section and a side section, the system comprising:

a first plurality of holes through the foundation wall;

a second plurality of holes partially through the foundation wall;

a drain board having a first side without holes located adjacent the foundation wall and a second side located adjacent the top section of the footer so as to cover the first plurality of holes and to cover the second plurality of holes, the drain board having an open section at the footer and the drain board covering the first and second plurality of holes;

a bed of stone adjacent the side section of the footer and below the top section of the footer;

a conduit resting in the bed of stone on a slope, the conduit having a plurality of perforations around a top section of the conduit and no holes in a bottom section of the conduit;

wherein water can flow through the first plurality of holes and the second plurality of holes and be guided by the drain board, through its open section over the top section of the footer and the side section of the footer into the conduit, wherein the foundation wall comprises a poured, solid concrete wall and the second plurality of holes in the foundation wall are below the floor level and end at an intersection of the footer and the foundation wall and the second plurality of holes are formed at an angle with respect to the floor.

15. The system of claim 14, further comprising pipe in the first plurality of holes and a filter in the pipe.

16. The system of claim 14, wherein each of the first plurality of holes has a diameter greater than each of the second plurality of holes and the first plurality of holes is spaced apart along the wall at least three feet between each of the first plurality of holes.

17. The system of claim 14, wherein the first plurality of holes is spaced apart along the foundation wall in the range of about four feet and seven feet and the second plurality of holes are formed in each cavity of each block.

18. The system of claim 17, wherein each of the first plurality of holes has a diameter greater than each of the second plurality of holes and the first plurality of holes is spaced apart along the wall at least three feet between each of the first plurality of holes.

19. The system of claim 14, wherein the drain board is waffled to create channels so that water flows through the channels.

20. The system of claim 1, wherein a diameter of the first plurality of holes is greater than a diameter of the second plurality of holes.

21. The system of claim 14, wherein a diameter of the first plurality of holes is greater than a diameter of the second plurality of holes.

* * * * *